US009952023B2

(12) United States Patent
Kuo

(10) Patent No.: US 9,952,023 B2
(45) Date of Patent: Apr. 24, 2018

(54) BOLTED TELESCOPIC ROD-TYPE DEFENSE SPRAY APPARATUS

(71) Applicants: Tai-Wang Kuo, Kaohsiung (TW); Shih-Shun Fu, Kaohsiung (TW)

(72) Inventor: Tai-Wang Kuo, Kaohsiung (TW)

(73) Assignees: Tai-Wang Kuo, Kaohsiung (TW); Shih-Shun Fu, Kaohsiung (TW)

( * ) Notice: Subject to any disclaimer, the term of this patent is extended or adjusted under 35 U.S.C. 154(b) by 149 days.

(21) Appl. No.: 15/007,583

(22) Filed: Jan. 27, 2016

(65) Prior Publication Data

US 2016/0305747 A1 Oct. 20, 2016

(30) Foreign Application Priority Data

Apr. 15, 2015 (TW) ..... 104205713 U

(51) Int. Cl.
*F41H 9/10* (2006.01)
*F41C 9/00* (2006.01)
*F41B 15/02* (2006.01)

(52) U.S. Cl.
CPC ..... *F41H 9/10* (2013.01); *F41C 9/00* (2013.01); *F41B 15/022* (2013.01)

(58) Field of Classification Search
CPC . F41H 9/00; F41H 13/018; A45B 3/00; F41B 9/0037; F41B 15/027; F41B 15/04; F41B 9/0087; F41B 15/022; F41C 9/04
USPC ..... 222/174; 239/532
See application file for complete search history.

(56) References Cited

U.S. PATENT DOCUMENTS 3,038,483 A * 6/1962 Altsheler ..... A45B 3/00 135/16
3,241,259 A * 3/1966 McBride ..... F41B 15/022 42/1.08
3,432,077 A * 3/1969 Voll ..... F41B 15/02 222/175
4,093,969 A * 6/1978 Maynor, Jr. ..... A45B 3/00 135/34.2
4,252,137 A * 2/1981 Cohen ..... A61H 3/02 135/69
4,819,137 A * 4/1989 Hamilton ..... F41B 15/025 362/102
4,860,776 A * 8/1989 McQuain ..... A45B 3/00 135/16
5,065,904 A * 11/1991 McCaffrey ..... F41H 9/10 135/19.5

(Continued)

*Primary Examiner* — Jason Boeckmann
(74) *Attorney, Agent, or Firm* — Juan Carlos A Marquez; Marquez IP Law Office, PLLC

(57) ABSTRACT

A bolted telescopic rod-type defense spray apparatus includes a first tube body, a cap, a compression elastic piece, a second tube body, an anti-extraction element, a spring pin component, and a push joint component. In the bolted telescopic rod-type defense spray apparatus, two sectioned tube pieces and a spring pin component and a push joint component that are between the two tube pieces are applied to lock and unlock a relative position relationship between the two tube pieces, so that the defense spray apparatus has composite functions of a rod-piece additional function of a locking configuration of relative positions of the two tube pieces and a press-lever spray irritant gas can of an unlocking configuration of the relative positions of the two tube pieces.

11 Claims, 8 Drawing Sheets

(56) References Cited

U.S. PATENT DOCUMENTS 5,282,332 A * 2/1994 Philips ..... F41H 13/0018 42/1.08
5,529,215 A * 6/1996 Banks ..... F21V 33/0064 222/113
5,842,601 A * 12/1998 Pierpoint ..... F41H 9/10 222/1
5,901,723 A * 5/1999 Ames ..... A45B 3/14 135/66
5,986,872 A * 11/1999 Chaput ..... A45B 3/00 135/16
6,091,597 A * 7/2000 Lin ..... F41B 15/04 361/115
6,386,726 B1 * 5/2002 Macierowski ..... A45B 3/00 362/102
6,499,855 B1 * 12/2002 Kukuk ..... F21V 33/0064 362/102
6,957,750 B1 * 10/2005 Trudell ..... A45B 3/14 135/66
7,421,933 B1 * 9/2008 Pearson ..... F41H 13/0018 361/232
7,525,786 B1 * 4/2009 Douglas ..... F41B 15/027 231/7
8,375,967 B1 * 2/2013 Stratton ..... A45B 3/14 135/66
9,257,026 B2 * 2/2016 Kalina ..... G08B 15/00
9,345,296 B1 * 5/2016 Lanear ..... A45B 3/14
2004/0264098 A1 * 12/2004 Eccles ..... H05C 1/00 361/232
2007/0167241 A1 * 7/2007 Stethem ..... A01K 15/02 463/47.3
2009/0038664 A1 * 2/2009 Juslin ..... A45B 3/00 135/66
2009/0199884 A1 * 8/2009 Lessing ..... A45B 3/00 135/66
2013/0015203 A1 * 1/2013 Zuloff ..... F41B 9/0037 222/113
2013/0150167 A1 * 6/2013 Pelkey ..... F41B 15/027 463/47.7
2014/0256452 A1 * 9/2014 Cheng ..... F41B 15/027 463/47.7
2015/0038239 A1 * 2/2015 Parsons ..... F41B 15/027 463/47.7
2015/0038240 A1 * 2/2015 Parsons ..... F41B 15/027 463/47.7
2016/0298939 A1 * 10/2016 Kuo ..... F41H 9/10
2016/0305747 A1 * 10/2016 Kuo ..... F41H 9/10

* cited by examiner

BOLTED TELESCOPIC ROD-TYPE DEFENSE SPRAY APPARATUS

BACKGROUND

Technical Field

The present invention relates to a bolted telescopic rod-type defense spray apparatus, and more particularly to a defense spray apparatus in which at least two sections may be pushed to each other to spray contents of an irritant gas can and may be positioned relative to each other to be locked into a function application having a rod-type member.

Related Art

A conventional umbrella or staff is easy to carry and can be used for defense; however, in a sudden strike of an armed villain, during a fierce fight, it is still possible that the villain causes death or injuries with a strike by using a bladed weapon.

In addition, a conventional device such as a gas pistol and a self-defense spray device can be used to spurt high-pressure self-defense spray at a villain at a long distance greater than 3 meters to 4 meters before the villain approaches; however, for a function or a dosage of the device, an irritant gas or liquid can only be spurted at the face of the villain for a very few seconds to take away the vision of the villain, and if the villain closes the eyes and covers the mouth and nose and keeps slashing wildly with a weapon, the gas pistol and the self-defense spray are basically useless to stop the villain. Moreover, for the purpose of portability, a self-defense spray can is generally small and has a small volume, and a dosage of an irritant gas in the self-defense spray can support only a limited quantity of times of spurting. When the self-defense spray can is emptied after several times of spurting, if a danger still exists, an article such as an umbrella needs to be used for defense to resist an attack.

SUMMARY

An objective of the present invention is to provide a bolted telescopic rod-type defense spray apparatus. In the bolted telescopic rod-type defense spray apparatus, two sectioned tube pieces and a spring pin component and a push joint component that are between the two tube pieces are applied to lock and unlock a relative position relationship between the two tube pieces, so that the defense spray apparatus has composite functions of a rod-piece additional function of a locking configuration of relative positions of the two tube pieces and a press-lever spray irritant gas can of an unlocking configuration of the relative positions of the two tube pieces.

To achieve the foregoing objective, the present invention provides a bolted telescopic rod-type defense spray apparatus, comprising: a first tube body, having a head-end portion and a tail-end portion, the head-end portion having a receiving chamber, having a relatively large diameter, of an intra-tube space, an opening being provided on an end surface of the receiving chamber, a neck-portion structure being provided in the intra-tube space, a first pinhole being formed on a surface of the tube body between the neck-portion structure and the tail-end portion; a cap, covering the opening of the receiving chamber, a recessed seat being provided at a center of a surface, facing the receiving chamber, of the cap, a through hole being provided at a center of the recessed seat, a press-ring portion of an irritant gas can corresponding to the recessed seat, and an output tube being aligned with the through hole; a compression elastic piece, disposed and kept between the recessed seat and the irritant gas can; a second tube body, a top rod structure being disposed at a head end of the second tube body, a sheath structure being disposed at a tail end of the second tube body, a hole being provided on an end surface of the sheath structure, a second pinhole being provided at a body portion of the second tube body, and the second tube body being partially placed inside the first tube body; an anti-extraction element, fixed on a surface of the second tube body, and stopped at the neck-portion structure; a spring pin component, placed inside the second tube body, comprising a shell body having a recessed seat and a slot, an insertion pin placed at the recessed seat, and a compression elastic body placed between the recessed seat and the insertion pin, the insertion pin being axially aligned with the second pinhole, and a body portion of the insertion pin having a groove; and a push joint component, placed inside the second tube body, and having a fingering element, a hook rod, a pulling rod switch, and a pulling rod switch locking structure, the fingering element having a pivotal hole, a tail hole, and a fingering rod, the fingering rod being inserted in the groove of the body portion of the insertion pin, the fingering element being pivotally disposed in the recessed seat and the slot by using the pivotal hole, the pulling rod switch sequentially having a switch button, a shaft-neck portion and a shaft-tail portion, the switch button passing through the hole on the end surface of the sheath structure via the shaft-neck portion and being exposed from the sheath structure, a joint being provided on an end surface of the shaft-tail portion, a hook portion being formed at an end of the hook rod, the hook portion being hooked in the tail hole of the fingering element, a flange portion being formed at the other end of the hook rod and entering the joint, and the pulling rod switch locking structure being disposed between the end surface of the sheath structure and the pulling rod switch, so that after the pulling rod switch is extracted, the pulling rod switch may be kept at an extracted position. In addition, the pulling rod switch is extracted outward, so that an external thread and a threaded hole are engaged with each other. The switch button is rotated, so that the insertion pin is completely extracted from the first pinhole and the second pinhole to release a locking state between the first tube body and the second tube body, the sheath structure of the second tube body is held and pushed toward the first tube body, and the top rod structure may push a bottom portion behind the irritant gas can, to press the press-ring portion to spray contents.

An advantage of the present invention lies in: In the present invention, a self-defense spray can and a rod-type umbrella or staff are combined, so that an irritant gas may be sprayed first and a rod-type object such as the umbrella and the staff may then be used to resist an attack of a villain, thereby improving an effect of safety protection. In addition, during walking in a mountain region or an uninhabited region, when there is a villain, a stray dog or an animal that attacks people, in a case of a headwind, if self-defense pepper spray is sprayed immediately, the spray may affect the one who sprays, so that for the rod-type structure of the umbrella of the present invention, the umbrella may be used first for defense against an attack of the villain or to drive away the animal that attacks people, and at a position of a tailwind, an irritant gas can be used to spray an irritant gas at the villain or the animal that attacks people, so that a double protection effect is achieved. Moreover, in the present invention, when a rod-type object is formed, the rod-type object itself also has a function of defense. For example, a rod piece such as a stick and an umbrella rod is used for strikes, and an extended cloth confuses the sight of the villain or the animal that attacks people or blocks a dangerous liquid sprayed by the villains. Therefore, an advanced apparatus that combines various defense functions is implemented.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

The embodiments of the present invention are described below in detail with reference to the accompanying drawings. The accompanying drawings are simplified schematic views, and a basic structure of the present invention is described in a schematic manner. Therefore, only elements related to the present invention are labeled in the accompanying drawings, and the shown elements are not drawn according to quantities, shapes, sizes, proportions, and the like during implementation. Specifications and sizes during actual implementation of the elements are actually an optional design, and the layout and forms of the elements may be more complex.

Figure 1:
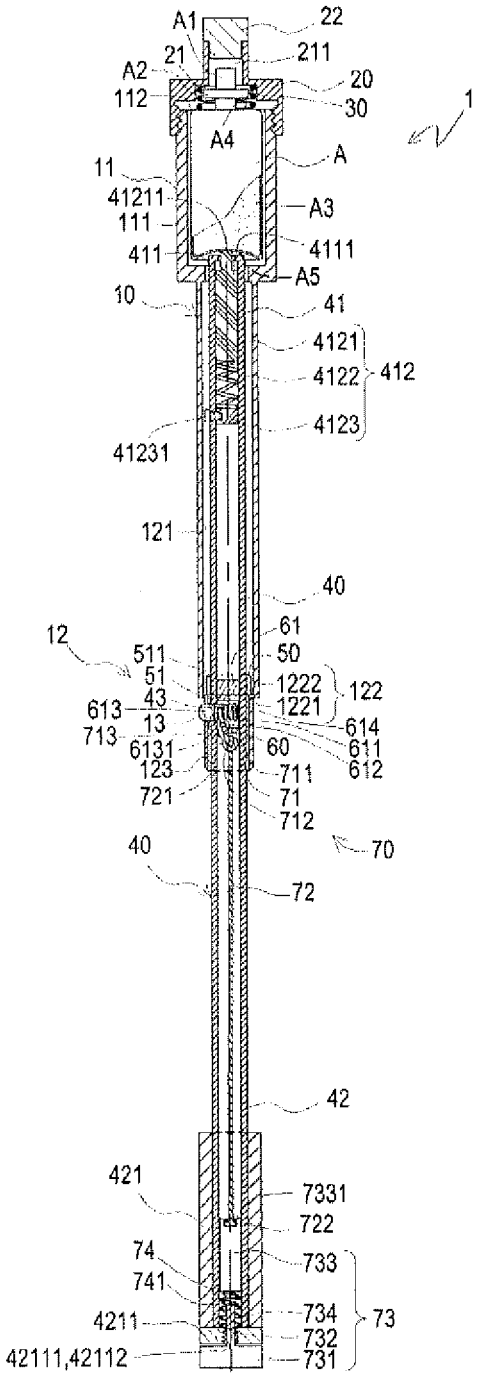
FIG. 1 is a schematic sectional view of an embodiment of a staff defense spray apparatus of a bolted telescopic rod-type defense spray apparatus according to the present invention.
Figure 2:
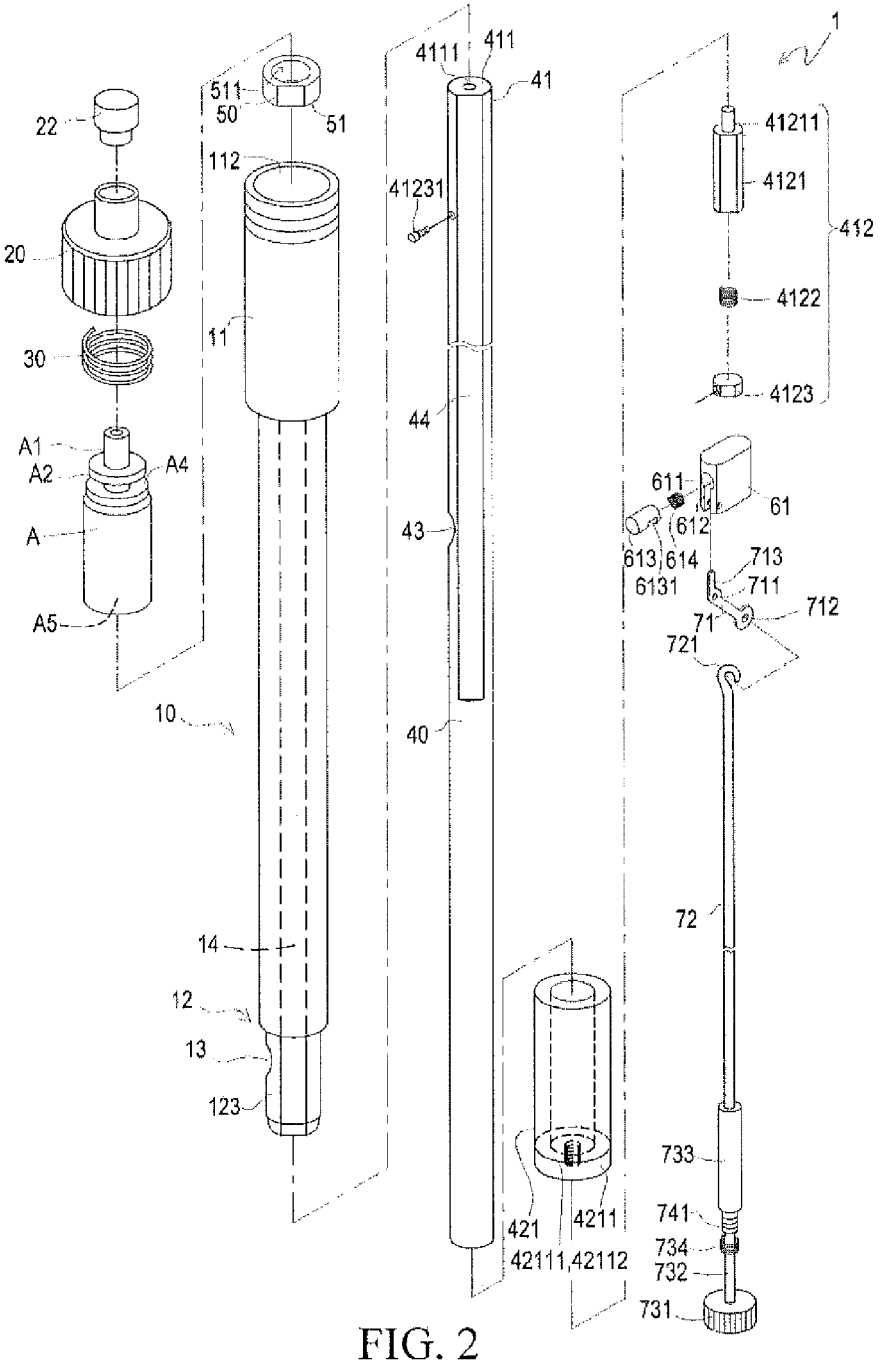
FIG. 2 is an exploded perspective view of the embodiment in FIG. 1.

First, please refer to FIG. 1 and FIG. 2. A bolted telescopic rod-type defense spray apparatus 1 in this embodiment is a two sectioned defense rod when a relative and axial movement of a telescopic rod is unlocked (if a tube body of the bolted telescopic rod-type defense spray apparatus 1 is shortened, the bolted telescopic rod-type defense spray apparatus 1 is a portable defense short stick). After the telescopic rod is unlocked, to spray contents A3 of an irritant gas can A disposed inside the apparatus, a protruding output tube A1 is provided at a top portion of the irritant gas can A, a press-ring portion A2 is provided at a periphery of the output tube A1, and the press-ring portion A2 may be subject to an external force of pressing to axially spray the contents A3 from the output tube A1.

Figure 6:
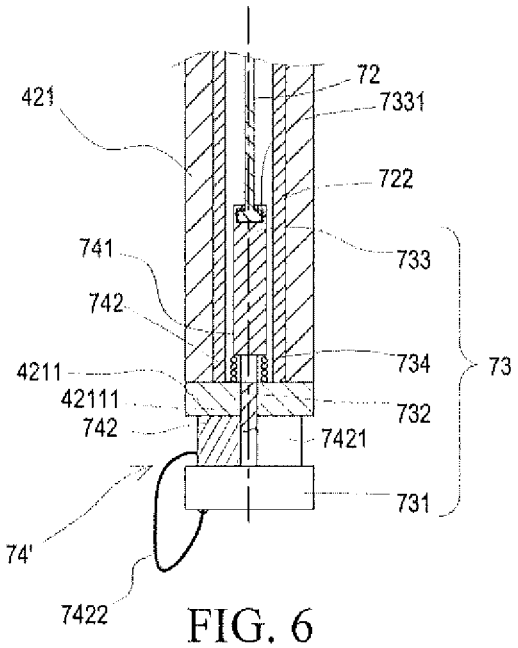
FIG. 6 is a schematic view of another implementation aspect of a pulling rod switch locking structure of a bolted telescopic rod-type defense spray apparatus according to the present invention.
Figure 8:
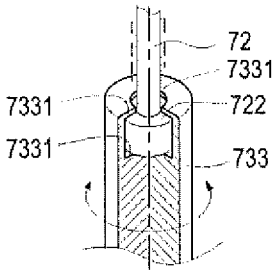
FIG. 8 is a sectional perspective view of a connection between a hook rod and a shaft-tail portion of a bolted telescopic rod-type defense spray apparatus according to the present invention.
Figure 9:
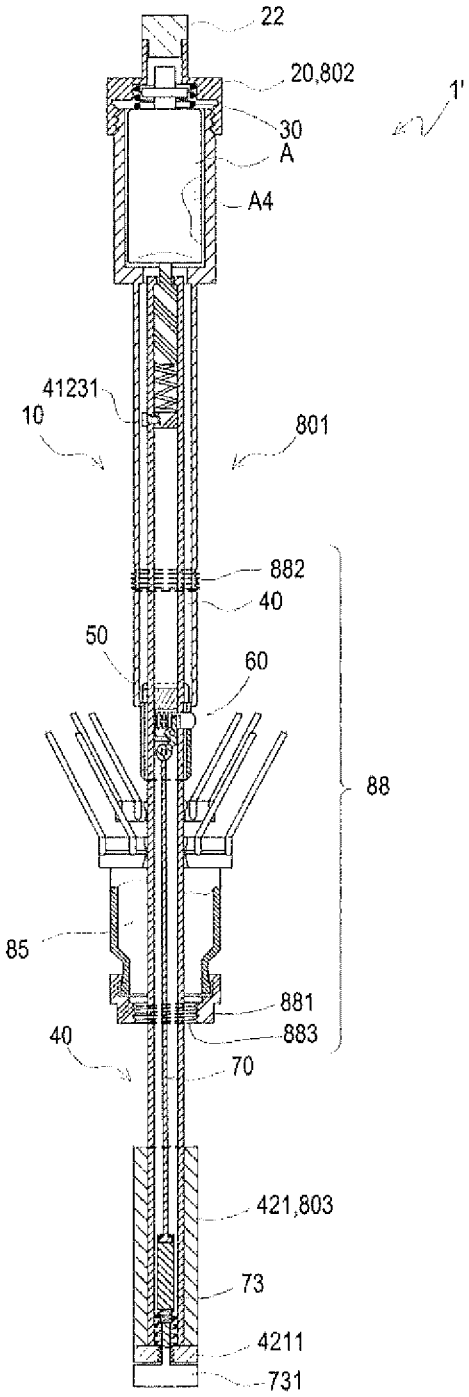
FIG. 9 is a schematic sectional view of an embodiment of an umbrella-type defense spray apparatus of a bolted telescopic rod-type defense spray apparatus according to the present invention.

The defense spray apparatus 1 includes: a first tube body 10, a cap 20, a compression elastic piece 30, a second tube body 40, an anti-extraction element 50, a spring pin component 60, and a push joint component 70. The first tube body 10 has a head-end portion 11 and a tail-end portion 12 away from the head-end portion 11. The head-end portion 11 has a receiving chamber 111, having a relatively large diameter, formed of an intra-tube space. An opening 112 is provided on an end surface of the receiving chamber 111 and is used to provide a position where the irritant gas can A is placed and received in the receiving chamber 111. A neck-portion structure 122 is provided in the intra-tube space. The neck-portion structure 122 may be an inward turning surface 1222 of a small inner diameter space 1221 whose diameter is less than the diameter of the intra-tube space, so that when a runner 85 and a runner locking structure 88 pass through, an insertion pin 613 is not touched, and the insertion pin 613 can be retracted into the second tube body 40, to achieve unlocking. A first pinhole 13 is formed on a surface of the tube body between the neck-portion structure 112 and the tail-end portion 12, and the first pinhole 13 is connected to the intra-tube space. The cap 20 tightly covers the opening 112 of the receiving chamber 111 (specifically, the cap 20 covers the opening 112 of the receiving chamber 111 in many manners; in practice, an external thread may be disposed on an outer side of an end surface of the opening 112, a corresponding inner thread is disposed on an inner edge of the cap 20, the cap 20 then covers the opening 112 in a threaded manner, or an L groove is provided on the outer side of the end surface of the opening 112, a corresponding convex end is disposed on the inner edge of the cap 20, the cap 20 is then pressed and rotated by a rotating angle to clamp the convex end in the L groove, to cover the opening 112), so as to close the receiving chamber 111. A recessed seat 21 is provided at a center of a surface, facing the receiving chamber 111, of the cap 20. A through hole 211 is provided at a center of the recessed seat 21, the press-ring portion A2 of the irritant gas can A corresponds to the recessed seat 21, and the output tube A1 is aligned with the through hole 211. The compression elastic piece 30 is disposed and kept between the recessed seat 21 and a can body top portion A4 of the irritant gas can A, and because of an elastic force of extension of the compression elastic piece 30, it may be avoided that after an umbrella is used in a rainy day, during an action of shaking off rainwater, the press-ring portion A2 is shaken, a centrifugal force is generated in the first tube body 10, and the recessed seat 21 is pressed accidentally to trigger spraying of the irritant gas can A. The second tube body 40 has a head end 41 and a tail end 42 opposite the head end 41, where a hole 4111 is provided on an end surface of the head end 41. A top rod structure 412 is disposed on the end surface of the head end 41. A sheath structure 421 is disposed at the tail end 42, a hole 42111 is provided on an end surface 4211 of the sheath structure 421, a second pinhole 43 corresponding to the first pinhole 13 is disposed at a body portion of the second tube body 40, the second tube body 40 is partially placed in the intra-tube space of the first tube body 10, and when the second pinhole 43 is aligned with the first pinhole 13, the body portion to the tail end 42 of the second tube body 40 are exposed from the tail-end portion 12 of the first tube body 10. The anti-extraction element 50 has a stopping surface 51, the stopping surface 51 has an inner diameter 511, the inner diameter 511 is over a surface of the second tube body 40 and is fixedly connected thereto. The stopping surface 51 is in a direction opposite the head-end portion 11 of the first tube body 10, and the stopping surface 51 faces and is stopped at the neck-portion structure 122. The spring pin component 60 is placed inside the second tube body 40, the spring pin component 60 includes a shell body 61, the shell body 61 has a recessed seat 611, a slot 612 connected to a space of the recessed seat 611, the insertion pin 613 placed inside the recessed seat 611, and a compression elastic body 614 placed between a bottom surface of the recessed seat 611 and a bottom surface, facing the recessed seat 611, of the insertion pin 613. The insertion pin 613 is axially aligned with the second pinhole 43, and a groove 6131 is provided at a body portion of the insertion pin 613. The push joint component 70 is placed inside the second tube body 40. The push joint component 70 has a fingering element 71, a hook rod 72, a pulling rod switch 73, and a pulling rod switch locking structure 74. The fingering element 71 has a pivotal hole 711 and a tail hole 712 and a fingering rod 713 that are separately located on two sides of the pivotal hole 711. The fingering rod 713 is inserted in the groove 6131 of the body portion of the insertion pin 613. The fingering element 71 is pivotally disposed in the slot 612 of the recessed seat 611 by using the pivotal hole 711, so that the fingering element 71 uses the pivotal hole 711 as an axial center, and inside the recessed seat 611, the fingering rod 713 drives the insertion pin 613 to swing back and fro toward the inside of the recessed seat 611. The pulling rod switch 73 sequentially has a switch button 731, a shaft-neck portion 732, a shaft-tail portion 733, and a compression spring 734. The switch button 731 passes through the hole 42111 on the end surface 4211 of the sheath structure 421 via the shaft-neck portion 732 and is then exposed from the sheath structure 421. A joint 7331 is provided on an end surface of the shaft-tail portion 733. The compression spring 734 is sleeved over the shaft-neck portion 732, and two ends of the compression spring 734 is kept between the shaft-tail portion 733 and an inner side of the end surface 4211 of the sheath structure 421. A hook portion 721 is formed at an end of the hook rod 72, the hook portion 721 is hooked at the tail hole 712 of the fingering element 71, and a flange portion 722 is formed at the other end of the hook rod 72 and is locked in the joint 7331 (the flange portion 722 is received inside the joint 7331, and is freely rotatable relative to the joint 7331, as shown in FIG. 6 and FIG. 8). A pulling rod switch locking structure 74' is disposed between the end surface 4211 of the sheath structure 421 and the pulling rod switch 73, so that after the pulling rod switch 73 is extracted in a direction of an outer side of the end surface 4211 of the sheath structure 421, the pulling rod switch 73 may be kept at an extracted position of the pulling rod switch; at this time, the compression spring 734 is in a state of being pressed. After the pulling rod switch locking structure 74' releases the pulling rod switch 73, the pulling rod switch 73 is pulled back to an original position by means of an elastic resilience of the compression spring 734.

Figure 3:
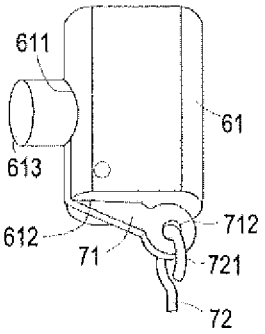
FIG. 3 is a schematic compositional view of a spring pin component in an embodiment of a bolted telescopic rod-type defense spray apparatus according to the present invention.
Figure 4:
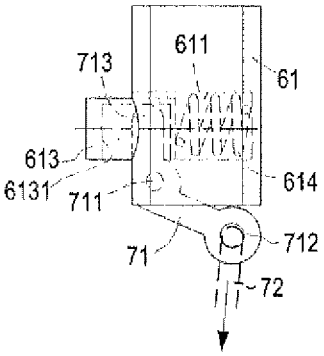
FIG. 4 is a front view of a locked state of a spring pin component in an embodiment of a bolted telescopic rod-type defense spray apparatus according to the present invention.
Figure 5:
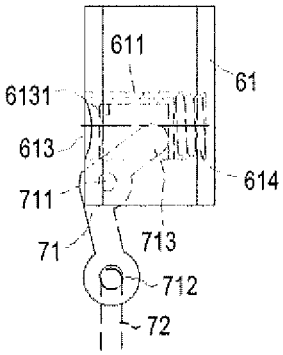
FIG. 5 is a front view of an unlocked state of a spring pin component of FIG. 4.

Continue to refer to FIG. 3, FIG. 4, and FIG. 5 for assistance, by means of the foregoing structure, when a user wants to use a function of defense spray and releases the first tube body 10 and the second tube body 40 that are locked to each other, the switch button 731 is extracted in a direction of the outer side of the end surface 4211 of the tail end 42 of the second tube body 40 and then rotated to enable an external thread 741 and a threaded hole 42112 to be engaged with each other, so as to enable the pulling rod switch 73 to pull the hook rod 72. The hook rod 72 pulls down the fingering element 71. The fingering element 71 can use the principle of levers to enable the fingering rod 713 to push down the insertion pin 613, so that the insertion pin 613 inserted in the groove 6131 enters the second tube body 40 to be completely extracted from the first pinhole 13 and the second pinhole 43, so as to release a locking state between the first tube body 10 and the second tube body 40. The first tube body 10 and the second tube body 40 are then separately held with two hands, and the sheath structure 421 of the second tube body 40 is pushed toward the first tube body 10, so that the top rod structure 412 can push the irritant gas can A to press the press-ring portion A2 to spray the contents A3.

Figure 10:
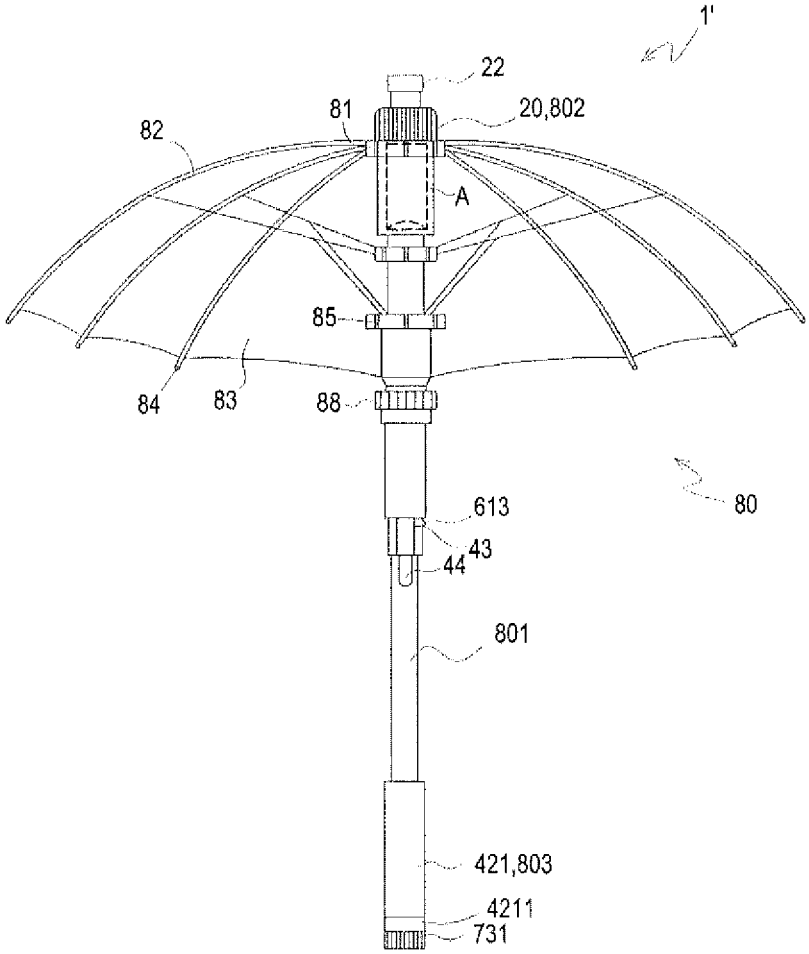
FIG. 10 is a schematic perspective view of an umbrella in an extended state in the embodiment of FIG. 4.

As shown in FIG. 2 and FIG. 10, in an embodiment, to avoid axial relative rotation between the first tube body 10 and the second tube body 40 to make it difficult to align the first pinhole 13 and the second pinhole 43, a corresponding anti-rotation structure (44, 14) is separately disposed on a tube body surface and a tube body inner surface of an area, inserted in the intra-tube space of the first tube body 10, of the second tube body 40 (in practice, non-circular section shapes are formed on the surfaces of the corresponding tube bodies in which one is sleeved over another, for example, a plane or the like is correspondingly disposed, and a corresponding plane is correspondingly disposed at a position corresponding to another part such as a fixing element 4123, a convex-type element 4121, and the anti-extraction element 50), so as to limit mutual rotation between the first tube body 10 and the second tube body 40.

In an embodiment, as shown in FIG. 1 and FIG. 3, the pulling rod switch locking structure 74 includes the external thread 741 disposed between the shaft-neck portion 732 and the shaft-tail portion 733 and the threaded hole 42112 that is formed corresponding to an inner thread, disposed at the hole 42111 of the end surface 4211 of the sheath structure 421, of the external thread 741. The switch button 731 is extracted and then rotated, to enable the external thread 741 to be engaged with the threaded hole 42112, so that the compression spring 734 is pushed to a limit to keep the pulling rod switch 73 at the extracted position, and after the switch button 731 is rotated in an opposite direction to enable the external thread 741 to leave the threaded hole 42112, the pulling rod switch 73 is pulled back to the original position by means of the elastic resilience of the compression spring 734, so that the spring pin component 60 can reset the insertion pin 613 to enable the first tube body 10 and the second tube body 40 to return to a state of being locked.

Figure 7:
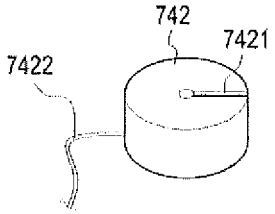
FIG. 7 is a perspective view of an embodiment of a fastening ring block of a bolted telescopic rod-type defense spray apparatus according to the present invention.

In another embodiment (as shown in FIG. 6 and FIG. 7), the pulling rod switch locking structure 74' includes a fastening ring block 742 disposed between the switch button 731 and the outer side of the end surface 4211 of the sheath structure 421. The fastening ring block 742 has an insertion groove 7421, and the shaft-neck portion 732 is clamped and held in the insertion groove 7421, so that the pulling rod switch 73 is kept at the extracted position, and after the fastening ring block 742 is removed, the pulling rod switch 73 is pulled back to the original position by means of the elastic resilience of the compression spring 734. Certainly, to use the fastening ring block 742 at any time, the fastening ring block 742 may be tied on the switch button 731 by using a rope 7422 or chain (not shown).

Please continue to refer to FIG. 1 and FIG. 2. The neck-portion structure 122 may be the inward turning surface 1222 of the small inner diameter space 1221 whose diameter is less than the diameter of the intra-tube space. That is, the tail-end portion 12 of the first tube body 10 has a sub-step tube 123 having a relatively small diameter. The first pinhole 13 in the foregoing embodiment may be disposed on a tube body of the sub-step tube 123, and an intra-tube portion of the sub-step tube 123 may also naturally form the neck-portion structure 122.

It should be noted that, in the foregoing embodiment, the top rod structure 412 may be directly implemented by using the end surface 411 of the head end 41 of the second tube body 40, to push a concave area of a can body bottom portion A5 to form sealing, or, in this embodiment, a hole 4111 is provided on the end surface 411 of the head end 41 of the second tube body 40, and the top rod structure 412 is disposed inside the second tube body 40 and sequentially includes a convex-type element 4121 having a top rod 41211, a compression spring 4122, and a fixing element 4123. The fixing element 4123 is fixedly screwed on an inner wall of the second tube body 40 by applying a screw 41231 to support the compression spring 4122, so that the convex-type element 4121 is pushed upward by the compression spring 4122, the top rod 41211 protrudes from the hole 4111, and a shortened travel length after the compression spring 4122 is pressed is less than a length by which the top rod 41211 protrudes from the hole 4111. In other words, when position locking between the first tube body 10 and the second tube body 40 is released, and the sheath structure 421 is held and pushed toward the first tube body 10, after the top rod 41211 of the convex-type element 4121 pushes the can body bottom portion A5 of the irritant gas can A, the convex-type element 4121 stops pushing temporarily; instead, the compression spring 4122 absorbs a pushing force from the sheath structure 421, and when the compression spring 4122 is shortened to a limit, the convex-type element 4121 may be pushed again to enable the end surface 411 of the second tube body 40 and the top rod 41211 to push the can body bottom portion A5 of the irritant gas can A, so that the recessed seat 21 presses the press-ring portion A2 to spray the contents A3. That is, the press-ring portion A2 in front is subject to a pushing force from behind and a blocking limit of the recessed seat 21 in front, and the can body top portion A4 compresses the compression elastic piece 30 to a limit, so as to spray the contents A3 from the output tube A1.

In addition, to keep a spray path of the irritant gas can A unobstructed, when a defense spray function is not used, an end plug 22 (the end plug 22 has a water-proof function) inserted in the through hole 211 is further included on a surface, opposite the receiving chamber 111, of the cap 20; however, before the defense spray function is used, the end plug 22 must be removed.

Please continue to refer to FIG. 1, FIG. 9, FIG. 10, and FIG. 11. A bolted telescopic rod-type defense spray apparatus 1' in this embodiment includes members such as the first tube body 10, the head-end portion 11, the cap 20, the second tube body 40, and the sheath structure 421 in the foregoing corresponding embodiment of two sectioned rods, and further includes an umbrella component 80 to form an umbrella-type defense spray apparatus. A rod body that includes the first tube body 10 and the second tube body 40 forms a central rod 801 of the umbrella component 80. The cap 20 forms an umbrella cap 802 of the umbrella component 80, the sheath structure 421 forms an umbrella handle 803 of the umbrella component 80, and the rest of the umbrella component 80 includes: a notch 81, a rib 82, a cloth 83, multiple tips 84, a runner 85, and the runner locking structure 88 for locking or unlocking the runner 85. The notch 81 is disposed at the head-end portion 11 of the first tube body 10, the runner 85 is sleeved at a periphery of the first tube body 10 and the second tube body 40 on a side, facing the sheath structure 421, of the notch 81 and is axially slideable on a peripheral surface of the runner. The runner locking structure 88 includes a spiral sheath-lock element 881 (an inner thread 883 is provided on an inner surface of the spiral sheath-lock element 881) that is sleeved over the runner 85 and is freely rotatable, and an external thread 882 that is disposed on a surface of the first tube body 10 and corresponds to the spiral sheath-lock element 881. The rib 82 is connected between the notch 81 and the runner 85, and the cloth 83 and the tips 84 are disposed on the rib 82. The cloth 83 is opened when the runner 85 moves to the surface of the first tube body 10 and is locked at the external thread 882, and the cloth 83 is folded when the runner 85 moves to a side, facing the sheath structure 421, of the external thread 882.

Figure 11:
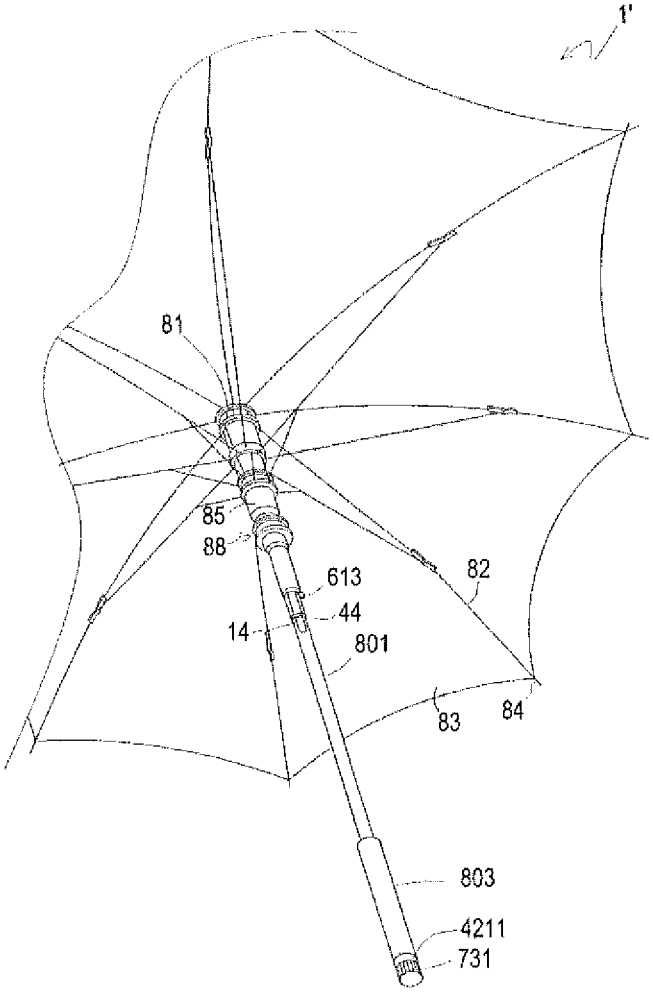
FIG. 11 is a perspective view from another angle in FIG. 10.
Figure 12:
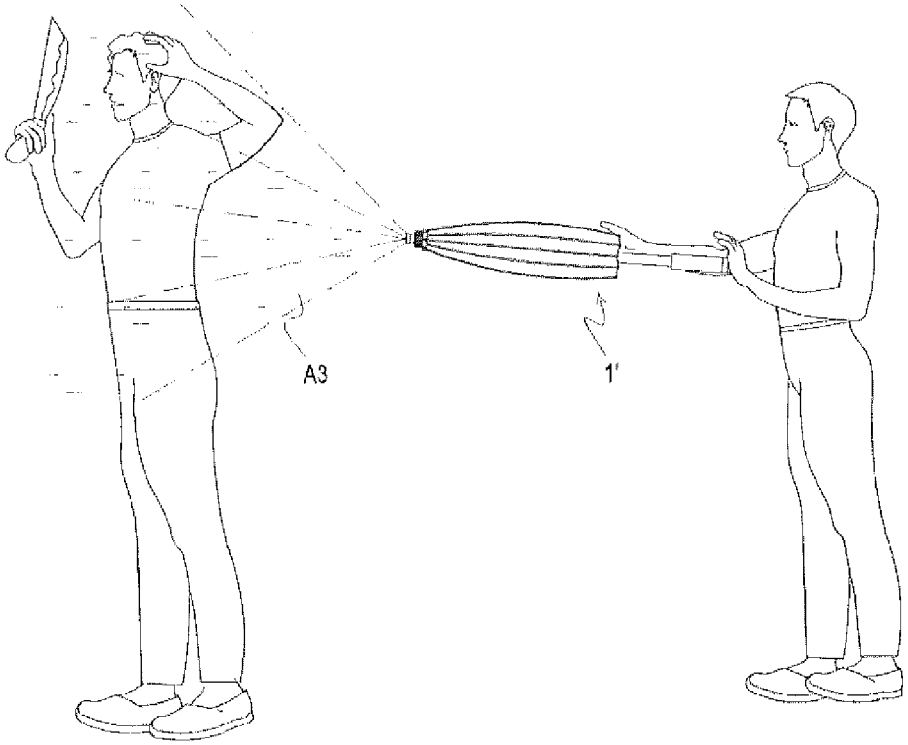
FIG. 12 is a schematic view of using a defense spray function in an embodiment of an umbrella-type defense spray apparatus of a bolted telescopic rod-type defense spray apparatus according to the present invention.

As shown in FIG. 12, in an embodiment of the foregoing umbrella-type defense spray apparatus according to the present invention, when the first tube body 10 and the second tube body 40 are locked to each other, the umbrella-type defense spray apparatus has a function for protection against sunlight or rain of a common umbrella (as shown in FIG. 10 and FIG. 11). However, when locking between the first tube body 10 and the second tube body 40 is released, that is, the contents A3 of the irritant gas can A can be sprayed from an end surface of the umbrella cap 802.

It should be noted that, in addition to the foregoing integration of a function of a staff, a cane or an umbrella into a defense spray apparatus, the present invention can further shorten the second tube body 40, so as to greatly reduce a volume and achieve higher portability.

In conclusion, the foregoing implementation manners or embodiments of the adopted technical means of the present invention are not used to limit the patent scope of the present invention. That is, all equivalent changes and modifications that conform to the meaning of the claims of the present invention or that are made according to the claims of the present invention shall fall within the patent scope of the present invention.

What is claimed is:

1. A bolted telescopic rod defense spray apparatus, used to spray contents of an irritant gas can disposed inside the apparatus after locked telescopic rods are unlocked, a protruding output tube being provided at a top portion of the irritant gas can, a press-ring portion being provided at a periphery of the output and being subject to an external force to spray the contents from the output tube, and the defense spray apparatus comprising:

a first tube body, having a head-end portion and a tail-end portion away from the head-end portion, a receiving chamber having a diameter being provided in an intra-tube space of the head-end portion, an opening being provided on an end surface of the receiving chamber and being used to provide a position where the irritant gas can is held in the receiving chamber, a neck-portion structure being provided in the intra-tube space, and a first pinhole connected to the intra-tube space being formed on a surface of the tube body between the neck-portion structure and the tail-end portion;

a cap, tightly covering the opening of the receiving chamber, a recessed seat being provided at a center of a surface, of the cap facing the receiving chamber, of the cap, a through hole being provided at a center of the recessed seat, the press-ring portion of the irritant gas can corresponding to the recessed seat, and the output tube being aligned with the through hole;

a compression elastic piece, disposed and kept between the recessed seat and a can body top portion of the irritant gas can;

a second tube body, having a head end and a tail end opposite the head end, a top rod structure being provided on an end surface of the head end, a sheath structure being disposed at the tail end, a hole being provided on an end surface of the sheath structure, a second pinhole corresponding to the first pinhole being provided at a body portion of the second tube body, the second tube body being partially placed in the intra-tube space of the first tube body, and when the second pinhole is aligned with the first pinhole, the body portion of the second tube body to the tail end being exposed from the tail-end portion of the first tube body;

an anti-extraction element, having a stopping surface, the stopping surface having an inner diameter, the inner diameter being over a surface of the second tube body, and the stopping surface being in a direction opposite the head-end portion of the first tube body, and facing and being stopped at the neck-portion structure;

a spring pin component, placed inside the second tube body, and comprising a shell body, the shell body having a recessed seat and a slot connected to the recessed seat, an insertion pin placed inside the recessed seat, a compression elastic body placed between a bottom surface of the recessed seat and a bottom surface of the insertion pin, the insertion pin being axially aligned with the second pinhole, and a groove being provided at a body portion of the insertion pin; and a push joint component, placed inside the second tube body, and having a fingering element, a hook rod, a pulling rod switch, and a pulling rod switch locking structure, the fingering element having a pivotal hole and a tail hole and a fingering rod that are separately located on two sides of the pivotal hole, the fingering rod being inserted in the groove of the body portion of the insertion pin, the fingering element being pivotally disposed in the slot of the recessed seat by using the pivotal hole, so that the fingering element uses the pivotal hole as an axial center, and inside the recessed seat, the fingering rod drives the insertion pin to swing toward and from the second tube body, the pulling rod switch sequentially having a switch button, a shaft-neck portion, a shaft-tail portion, and a compression spring, the switch button passing through the hole on the end surface of the sheath structure via the shaft-neck portion and being exposed from the sheath structure, a joint being provided on an end surface of the shaft-tail portion, the compression spring being sleeved over the shaft-neck portion, two ends of the compression spring being kept between the shaft-tail portion and an inner side of the end surface of the sheath structure, a hook portion being formed at an end of the hook rod, the hook portion being hooked at the tail hole of the fingering element, a flange portion being formed at the other end, and being locked in the joint, the pulling rod switch locking structure being disposed between the end surface of the sheath structure and the pulling rod switch, so that after the pulling rod switch is extracted toward an outer side of the end surface of the sheath structure, the pulling rod switch is kept at an extracted position, wherein the switch button is extracted in a direction of the outer side of the end surface of the tail end of the second tube body to enable an external thread and a threaded hole to be engaged with each other and then rotated to enable the insertion pin to be completely extracted from the first pinhole and the second pinhole, so that after a locking state between the first tube body and the second tube body is released, the sheath structure of the second tube body is held and pushed toward the first tube body, and the top rod structure pushes the irritant gas can to press the press-ring portion to spray the contents.

2. The bolted telescopic rod defense spray apparatus according to claim 1, wherein an anti-rotation structure is separately and correspondingly disposed on tube body surfaces of an area, inserted in the intra-tube space of the first tube body, of the second tube body, so as to limit relative axial rotation between the first tube body and the second tube body.

3. The bolted telescopic rod defense spray apparatus according to claim 1, wherein the pulling rod switch locking structure comprises the external thread disposed between the shaft-neck portion and the shaft-tail portion and the threaded hole that is formed corresponding to an inner thread, disposed at the hole of the end surface of the sheath structure, of the external thread, and a compression spring is sleeved over the shaft-neck portion disposed between the external thread and the switch button.

4. The bolted telescopic rod defense spray apparatus according to claim 1, wherein the pulling rod switch locking structure comprises a fastening ring block disposed between the switch button and the outer side of the end surface of the sheath structure, the fastening ring block is inserted and held in the shaft-neck portion.

5. The bolted telescopic rod defense spray apparatus according to claim 1, wherein a sub-step tube having a diameter is provided at the tail-end portion of the first tube body, and the first pinhole being provided on a tube body of the sub-step tube.

6. The bolted telescopic rod defense spray apparatus according to claim 1, wherein the neck-portion structure of the first tube body is an inward turning surface of a small inner diameter space whose diameter is less than the diameter of the intra-tube space.

7. The bolted telescopic rod defense spray apparatus according to claim 1, wherein an end plug inserted in the through hole is further comprised on a surface, opposite the receiving chamber, of the cap.

8. The bolted telescopic rod defense spray apparatus according to claim 1, wherein the top rod structure is the end surface of the head end.

9. The bolted telescopic rod defense spray apparatus according to claim 1, wherein a hole is provided on the end surface of the head end of the second tube body, the top rod structure is disposed inside the second tube body and sequentially comprises a convex element having a top rod, a compression spring, and a fixing element, the fixing element is fixedly screwed on an inner wall of the second tube body, so that the convex-type element is pushed upward by the compression spring, the top rod protrudes from the hole, and a shortened travel length after the compression spring is pressed is less than a length by which the top rod protrudes from the hole, and in a locking state between the first tube body and the second tube body, the top rod of the convex element pushes a can body bottom portion.

10. The bolted telescopic rod defense spray apparatus according to claim 1, wherein an included angle is formed between a central line from the pivotal hole of the fingering element to the tail hole and a central line from the pivotal hole to the fingering rod.

11. The bolted telescopic rod defense spray apparatus according to claim 1, further comprising an umbrella component, wherein a rod body that comprises the first tube body and the exposed second tube body form a central rod of the umbrella component, the cap forms an umbrella cap of the umbrella component, the sheath structure forms an umbrella handle of the umbrella component, the umbrella component further comprises a notch, a rib, a cloth, multiple tips, a runner, and a runner locking structure for locking or unlocking the runner, the notch is disposed at the head-end portion of the first tube body, the runner is disposed at a periphery of the central rod on a side, facing the sheath structure, of the notch and is axially slideable on a surface of the central rod, the runner locking structure comprises a spiral sheath-lock element sleeved over the runner and is freely rotatable, and an external thread that is disposed on a surface of the first tube body and corresponds to the spiral sheath-lock element, the rib is connected between the notch and the runner, the cloth and the tips are disposed on the rib, the cloth is opened when the runner moves to the surface of the first tube body and is locked at the external thread by using an inner thread disposed on an inner surface of the spiral sheath-lock element, and the cloth is folded when the runner moves to a side, facing the sheath structure, of the external thread.

* * * * *